US006817470B1

(12) United States Patent
Goldberg

(10) Patent No.: US 6,817,470 B1
(45) Date of Patent: Nov. 16, 2004

(54) DISPOSABLE SLEEVE FOR COVERING HAND-HELD ELECTRONIC DEVICES

(75) Inventor: Michael J. Goldberg, 32022 Kenyon Cir., Solon, OH (US) 44139

(73) Assignees: Kimberly E. Brown, Solon, OH (US); Michael J. Goldberg, Solon, OH (US)

( * ) Notice: Subject to any disclaimer, the term of this patent is extended or adjusted under 35 U.S.C. 154(b) by 26 days.

(21) Appl. No.: 09/975,101

(22) Filed: Oct. 11, 2001

Related U.S. Application Data

(60) Provisional application No. 60/240,595, filed on Oct. 13, 2000.

(51) Int. Cl.[7] ..... B65D 85/00

(52) U.S. Cl. ..... 206/320; 150/165; 383/36

(58) Field of Search ..... 206/305, 320, 206/521; 150/154, 165; 383/36, 904, 34, 35; 141/390

(56) References Cited

U.S. PATENT DOCUMENTS 3,797,734 A * 3/1974 Fleury et al. ..... 383/36
3,983,914 A * 10/1976 Benson ..... 141/390
4,838,327 A * 6/1989 Ambler et al. ..... 383/36
4,901,852 A 2/1990 King
5,030,013 A * 7/1991 Kramer ..... 383/36
5,056,932 A * 10/1991 Young ..... 383/36
5,092,459 A 3/1992 Uljanic et al.
5,175,876 A 12/1992 Villacis Mendoza
5,205,473 A 4/1993 Coffin, Sr.
5,265,720 A 11/1993 Meliconi
5,316,141 A 5/1994 Jalomo
D355,302 S 2/1995 Eva et al.
D368,095 S 3/1996 McCallister, III
5,499,713 A * 3/1996 Huffer ..... 206/320
D378,020 S 2/1997 Hatt
5,839,831 A * 11/1998 Mazzocchi ..... 383/35
5,873,456 A 2/1999 Hull et al.
D409,200 S 5/1999 Cooper
6,082,535 A * 7/2000 Mitchell ..... 206/320
6,105,778 A * 8/2000 Tsai ..... 206/305
6,345,911 B1 * 2/2002 Young et al. ..... 383/34

* cited by examiner

*Primary Examiner*—Luan K. Bui
(74) *Attorney, Agent, or Firm*—Hahn Loeser + Parks, LLP

(57) ABSTRACT

The present invention discloses a disposable, collapsible sleeve holder for germ-free and bacteria-free handling and operation of remote controls and similar devices.

15 Claims, 4 Drawing Sheets

DISPOSABLE SLEEVE FOR COVERING HAND-HELD ELECTRONIC DEVICES

This application claims the benefit of U.S. Provisional Application No. 60/240,595 which was filed on Oct. 13, 2000.

TECHNICAL FIELD

The present invention relates to a flexible, protective covering structure for remote controls and similar devices.

BACKGROUND

Remote control devices are used to operate a variety of electronic devices, televisions, VCRs, stereos, and electronic toys being obvious examples. The remote control is often the simplest and most convenient method of operating these devices.

Several forms of covering structures are known in the prior art for use with electronic devices. For instance, U.S. Pat. No. 5,499,713 discloses a transparent envelope for enclosing a remote control. This patent teaches a device having a closing web which permits entrance of the remote control into the envelope, and is then closed after the remote control is placed therein. The device is also flexible so that the remote control can be used through a depression of the flexible envelope material. In another example, U.S. Pat. No. 5,316,141 provides a cover for an electronic device having four walls, a bottom, and a flap to fold over the open end of the cover. This patent discloses a cover constructed of a polyvinyl chloride material to protect the remote control from damage due to dust, other particulate matter, fluids, bumps or collisions. Still another example of the prior art is U.S. Pat. No. 5,175,876. This patent discloses a remote controller bag which is formed of a flexible, transparent material to permit operation of the remote control through the cover as well as to provide impact resistance. All of the above mentioned devices were developed primarily to protect the remote control from damage from collisions, dust, spills and other environmental factors. None of the known devices are designed for protecting a user's hands from potential unsanitary conditions associated with remote controls.

Remote control devices are found in homes throughout the world, but, homes are not the only places where remote control type devices are popular. Due to the ever increasing popularity and ease of travel, hotels, other hospitality industry institutions and even hospitals are adding more and more entertainment devices to rooms available to travelers. Because many different people will stay in a single room at various times, these electronic devices are handled by many people who have a variety of hygiene habits. Often, these devices are forgotten or neglected when rooms are cleaned between guests in a hotel room or patients in a hospital room. Further, these devices are difficult to clean without damaging the electronic components. Although some cleaning methods are available, such methods are generally more time consuming because remote controls must be carefully cleaned to avoid harming the electronic components. For these and various other reasons, remote controls which may be used by many people are not cleaned and/or sanitized between users.

It would be an improvement over the prior art to provide a cover for a remote control and other such devices which can be applied and used in a manner which will protect a user's hands from any unsanitary conditions associated with the device.

SUMMARY OF THE INVENTION

In view of the limitations inherent in the prior art, the present invention provides a cover for remote controls and similar devices which can be applied to remote controls and similar devices to prevent the user's hands from encountering any unsanitary conditions. The cover of the present invention is in the form of a disposable, collapsible, sleeve holder for germ-free and bacteria-free handling and operation of various types of remote control units, telephone handsets, and/or other hand held electronic devices.

The cover for a hand-held electronic device in accordance with the present invention is comprised of a flexible sleeve having an opening in at least one end thereof and an applicator means for placing the sleeve over the device.

The sleeve is comprised of a top wall and a bottom wall joined at two side walls. The top, bottom and side walls are all joined at a rear wall. The top, bottom and side walls define an opening in the sleeve opposite the rear wall.

In one embodiment of the present invention, the applicator is an open tubular member which is open at both ends. One end is secured, releasably or permanently, to the opening of the sleeve, while the other end is capable of receiving the electronic device to cover the device.

It is an object of the present invention to provide a flexible, transparent sleeve having an applicator portion such that the remote control can be covered with minimal or no need for a user to touch the surface of a remote control.

It is another object of the present invention to provide a sleeve for enclosing a remote control such that the remote control may still be used as intended while enclosed.

It is a further object of the present invention to provide a flexible, transparent sleeve for a remote control which is inexpensive and simple to construct.

It is a further object of the present invention to provide a sleeve that fits various types and sizes of remote controls and other similar electronic hand held devices.

It is another object of the present invention to provide a covering for a remote control which protects the remote control from various environmental elements which may damage the remote control or cause the remote control to be unsanitary.

These and other advantages and novel features of the present invention will become apparent in the following detailed description of the invention when considered in conjunction with the accompanying drawings.

DETAILED DESCRIPTION OF THE INVENTION

In the following detailed description of the preferred embodiments of the present invention, reference is made to the accompanying drawings which, in conjunction with this detailed description, illustrate and describe a disposable sleeve for covering an electronic device, particularly a hand-held electronic device such as a remote control, and a method of using the same. The invention may also be embodied in many different forms and should not be construed as limited to only the disclosed embodiments. The provided embodiments are included so the disclosure will be thorough, complete and will fully convey the scope of the invention to persons of ordinary skill in the art.

Figure 1:
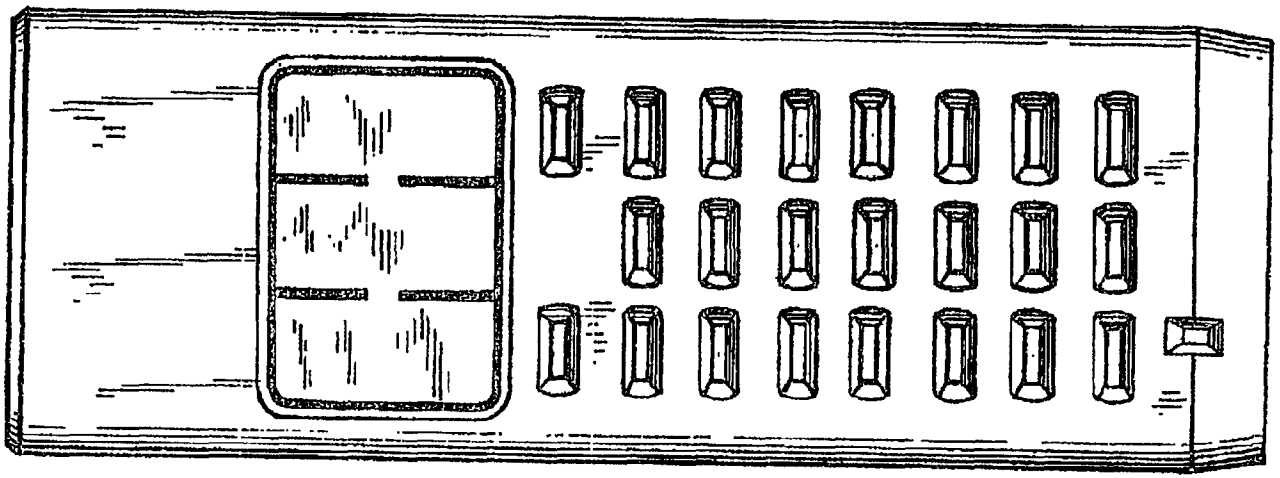
FIG. 1 illustrates a typical remote control device.

FIG. 1 illustrates a typical remote control. Presently, remote controls come in a variety of shapes, sizes and styles and the present invention is intended to fit many different types of remote controls. Although the present specification describes a sleeve for remote controls, it is also contemplated that this device may be used on other types of electronic devices, including but not limited to hand held video game controllers, computer mouses, public telephone receivers, and pagers such as those used in restaurants to notify patrons of when their tables are ready.

Figure 3:
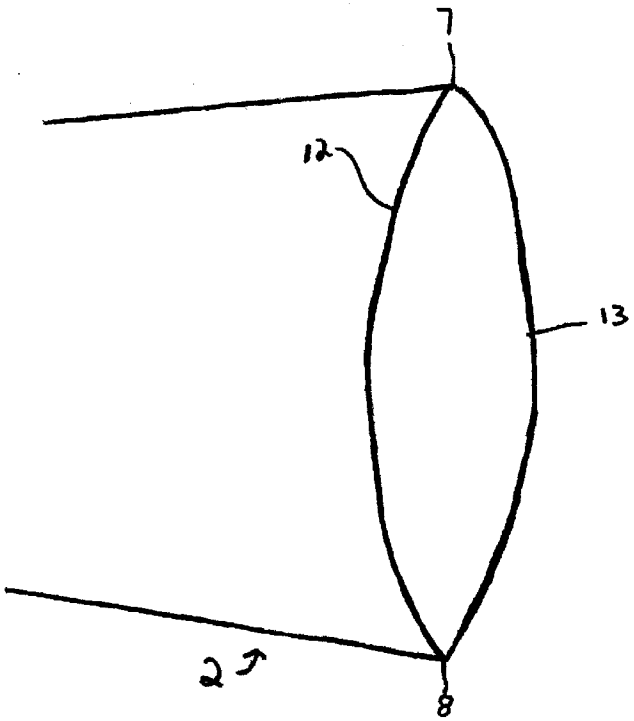
FIG. 3 illustrates a second view of the applicator device of the present invention.
Figure 2:
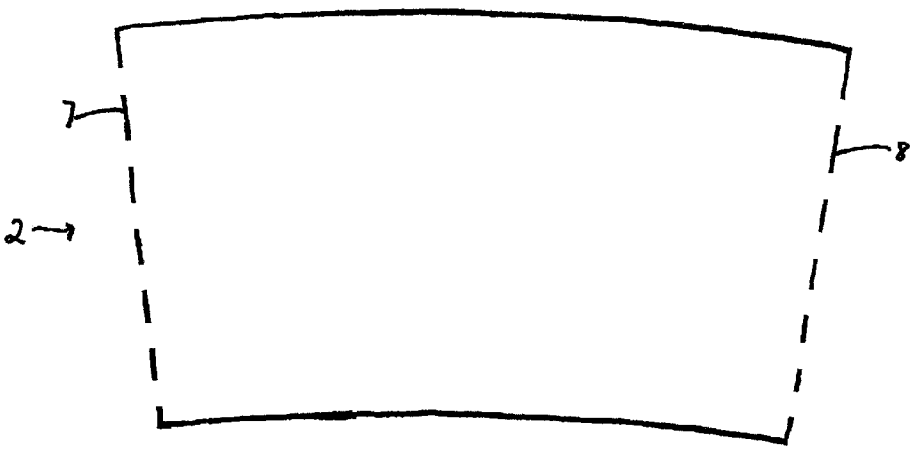
FIG. 2 illustrates a first view of the applicator device of the present invention.
Figure 6:
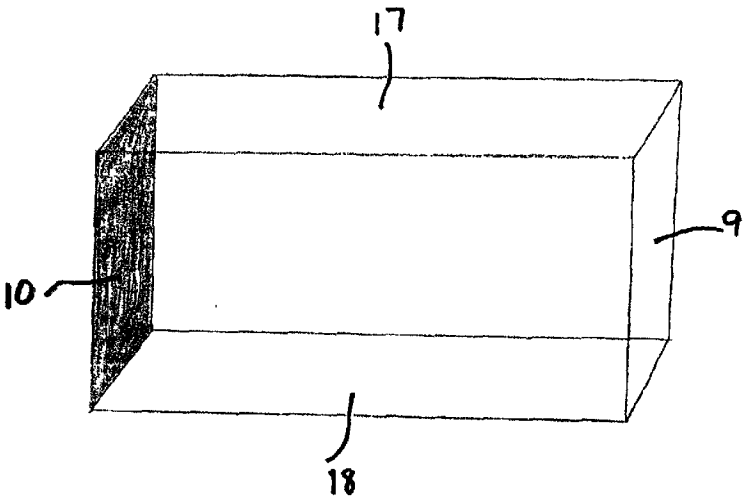
FIG. 6 illustrates a side view of the sleeve of the present invention.

FIG. 2 represents a side view of the collapsible, applicator portion of the present invention. The applicator may be constructed of a variety of materials including but not limited to paper, cardboard, plastics and flexible metals, such as tin or aluminum. The applicator portion may be constructed by a variety of methods. For instance, the applicator may be comprised of a piece of heavy paper or flexible plastic secured into a circle, oval or arcuate shape. The paper or plastic may then be scored or folded on opposite ends 7–8 such that the applicator folds flat as shown in FIG. 2. Alternatively, the applicator will be provided with a living hinge on ends 7–8. Living hinges are thin sections of plastic that connect two segments of a part to keep them together and allow the part to be opened and closed. In this configuration, pressure can be placed on each side 7–8 of the applicator such that the applicator will open to form a conical, tube-like mouth structure as shown in FIG. 3. The applicator 2 will be described herein as having an upper surface 12 and a lower surface 13 for ease of description of the use of the invention. It is also contemplated that the applicator portion of the present invention may be formed in various other shapes. The applicator may be curved as shown. Another preferable configuration would be to provide a rectangular or square applicator having straight edges. Other shapes may include but are not limited to circular, hexagonal, octagonal and various other shapes with various numbers of sides and surfaces.

The size of the applicator may be determined by size of the sleeve to which it will be attached and/or the size of the remote control or other device it will be used to cover. It is contemplated by the present invention that the opening 9 of the applicator portion will be at least slightly larger than the device that will be covered so that the remote control will easily fit through the applicator portion. Applicator portions may be constructed in various sizes such as small, medium and large to fit various remote controls or devices of various sizes. Alternatively, applicators may be made as "one size fits all" such that a single sleeve and applicator combination may be used for any or most remote control or other electronic devices.

The sleeve or bag portion of the present invention, generally designated by reference numeral 4, is shown in various forms in FIGS. 4–9 and is preferably constructed of a flexible, transparent material such as polyethylene. The sleeve material may be of varying thickness. Preferably, the sleeve is a thin sheet of material, but it is contemplated that the sleeve material may be of any thickness so long as the remote control device may be operated through the sleeve.

In one embodiment, the sleeve comprises a top portion 17 and a bottom portion 18 which are connected at opposite, spaced, side portions 15–16 and a closed end portion 10. Sleeve 4 also comprises an open end portion 9 for receiving the remote control. Sleeve may also be a conical shape with a closed end and an open end. In addition, the sleeve is preferably designed such that it covers the entire remote control or other device. However, the objects of the present invention will also be met by a sleeve which covers at least a portion of the remote control or device such that a user can use the device without the need for his hands to come into direct contact with the device.

Further, it is contemplated by the present invention that the sleeves could be formed in a variety of shapes such that the sleeve will fit various types of electronic devices. For example, the sleeves may have a generic rectangular, oval, or conical shape and be of a size that will fit most standard sized remote controls. The sleeves may also be designed in various sizes, such as small, medium and large, for various sizes of remote controls or other electronic devices. Or, the sleeves may be made as "one size fits all" such that the sleeves will fit some remote controls more loosely and others more tightly. In addition, the sleeves may be made in sizes designed to fit specific brands or types of remote controls.

The present invention should not be limited to any particular dimensions. It is intended that the applicators and sleeves of the present invention can be constructed to fit remote controls of any shapes or sizes.

Figure 4:
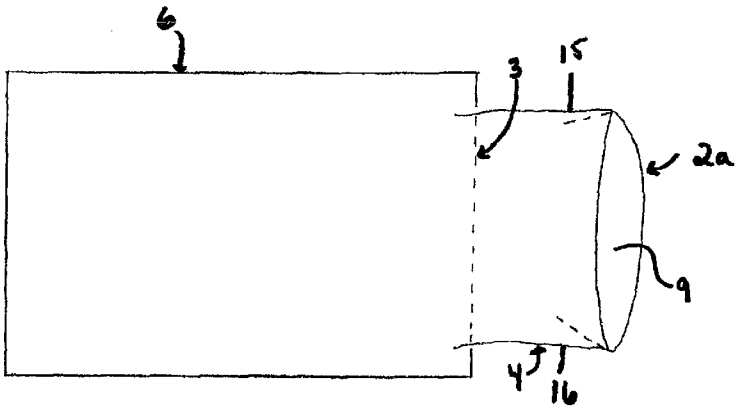
FIG. 4 illustrates a first embodiment of the sleeve and applicator device of the present invention.
Figure 5:
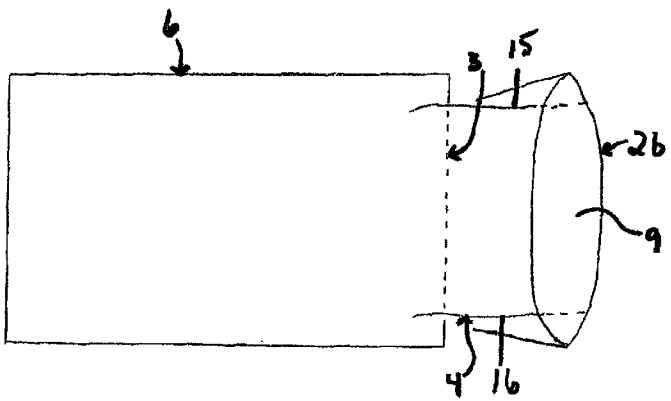
FIG. 5 illustrates a second embodiment of the sleeve and applicator device of the present invention.

FIGS. 4–5 illustrate how the sleeve and applicator portions of the present invention may be used. In one embodiment, a plurality of sleeves will be packaged together, such as in a bag, carton or secured together by some known mechanical means. The shown embodiment shows a carton type packaging 6 having an opening 3 therein for removal of the sleeves 4. In the embodiment shown in FIG. 4, the opening 9 of the sleeve is placed around the outside portion of the applicator 2*a*. In a preferred embodiment, the applicator 2*a* is permanently affixed to the sleeve 4 by a permanent adhesive or other known mechanical means, so that it is a permanent part of the sleeve 4.

In alternatives to this embodiment, the sleeve may have a pressure sensitive adhesive around the sleeve opening 9, the adhesive being easily attached, detached and reattached to other surfaces or to itself. In use, the opening 9 of the sleeve 4 is placed around the applicator 2*a* and pressure is placed on the adhesive to secure the sleeve 4 to the applicator 2*a*. Adhesive may also be placed on the outer surface of the applicator 2. In an alternative embodiment, a user may manually hold the outer portion of the opening 9 of sleeve 4 against the applicator 2*a* or use a detachable mechanical means such as a clip to fasten the sleeve to the applicator.

In another embodiment, shown in FIG. 5, the applicator 2*b* is placed around the end of the sleeve 4 having the opening 9. In this embodiment, the sleeve may have a pressure sensitive adhesive around the outer periphery of the opening so that the sleeve may be releasably attached to the inside surface of the applicator. In a preferred embodiment, the applicator 2*b* may be permanently affixed to sleeve 4, by a permanent adhesive on the outer periphery of the sleeve and/or inner surface of the applicator. Alternatively, the sleeve may be fastened to the applicator 2*b* by a clip or other mechanical means or by a pressure sensitive adhesive, similar to the embodiments described above.

Figure 7:
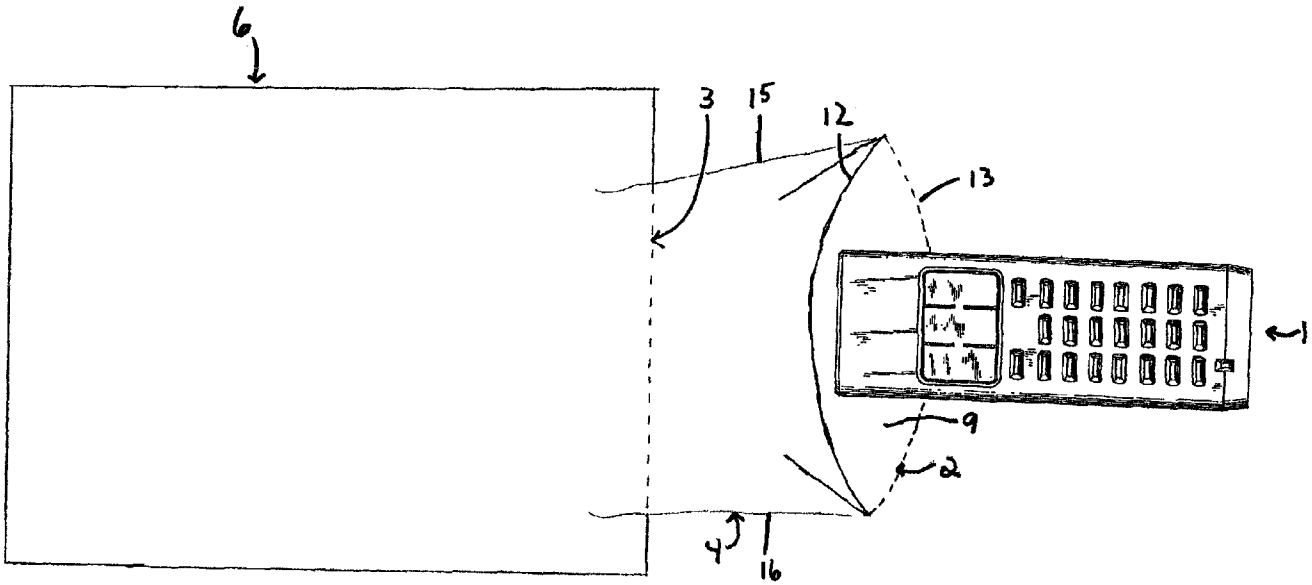
FIG. 7 illustrates the placement of the present invention on a typical remote control.

FIG. 7 illustrates a method of use of the present invention. Any of the embodiments shown in FIGS. 4 or 5 or described above may be used as shown in FIG. 7. The applicator 2 is attached to the sleeve 4. Sleeve 4 may be an individual sleeve or may be removed from a package 6 as shown. Holding the applicator 2 with one or two hands, a user may open applicator 2 by squeezing sides 7–8. The user may then "scoop" up the remote control with the applicator 2 by placing lower surface 13 of the applicator 2 underneath the remote control 1. The user may also position the remote control in the applicator portion. The applicator 2 and sleeve 4 may then be pulled around the remote control with or without touching the device. The remote control 1 will be enclosed within sleeve 4. It should be noted that the remote control 1 can be in any orientation in the sleeve 4 and the present invention should not be limited to any specific orientation of the remote control or other device by the drawings.

After the remote control 1 or other device is enclosed in sleeve 4, the remote control may be used for its intended purpose. In the embodiment shown in FIG. 8 the applicator 2*c* may be left on the sleeve 4*a* while the device is in use. In one embodiment, the applicator is permanently affixed to the sleeve and thus the invention would be used in this manner. After the applicator 2 and sleeve 4 have been used to cover the remote control as described herein, the applicator 2 may be collapsed to enclose the remote 2.

Figure 9:
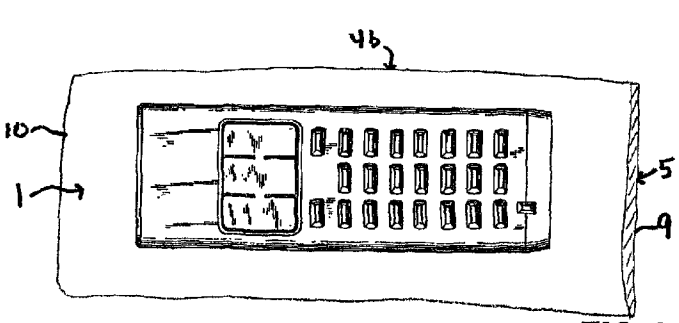
FIG. 9 illustrates a second embodiment of the present invention as placed on a typical remote control.
Figure 8:
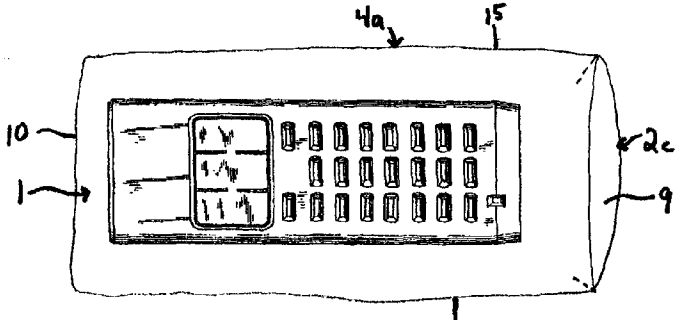
FIG. 8 illustrates a first embodiment of the present invention as placed on a typical remote control.

In the embodiment shown in FIG. 9, the sleeve is equipped with a pressure sensitive adhesive around the inner periphery of the opening of the sleeve. In this embodiment, the sleeve is applied to the remote control and the applicator portion is removed. The sleeve can then be "sealed" as shown by reference numeral 5 by pressing either the top and bottom portions of the opening together or by pressing the two side portions together at the opening. The remote control can be easily removed from the sleeve by pulling apart the pressure sensitive adhesive at the opening 9.

The present invention may be used for covering a variety of devices, including but not limited to any types of remote controls used to operate entertainment devices. In addition, the sleeve may be used to cover video game controllers so that the controllers can still be used to play the game effectively. Further, the present invention could be used to cover computer mouses. In this case, the sleeve would be large enough so that the mouse could be moved around for effective operation of the computer. The invention could also be effectively used in restaurants or other establishments to cover paging devices distributed to notify patrons who are waiting for tables. The device may also be used to cover telephone handsets, so that a user can still hold the handset and talk into the receiver with minimal or no contact between the user's hands, ears and/or face and the surface of the handset. This list is intended as example only, and is not intended to limit the scope of the present invention in any way.

The invention has been described with reference to several embodiments. Obviously, modifications and alterations will occur to others upon the reading and understanding of the specification. It is intended to include all such modifications and alterations insofar as they come within the scope of the appended claims or the equivalents thereof.

What is claimed is:

1. A cover for an electronic device comprising:

a flexible sleeve, said sleeve having an opening in at least one end thereof for receiving an electronic device, wherein said sleeve is configured to allow the electronic device to be selectively removed from said sleeve;

a means for applying said flexible sleeve onto said electronic device; and an electronic device positioned inside said sleeve, wherein, said means for applying said flexible sleeve onto said electronic device is releasably attached to said opening.

2. The cover for an electronic device as recited in claim 1 wherein said sleeve is comprised of plastic.

3. The cover for an electronic device as recited in claim 1 wherein said sleeve is transparent.

4. The cover for an electronic device as recited in claim 1, wherein said sleeve opening further comprises a pressure sensitive adhesive on an inner periphery of said sleeve opening, for selectively sealing said sleeve opening.

5. The cover for an electronic device as recited in claim 1, wherein said means for applying said flexible sleeve onto said electronic device is comprised of a material selected from the group consisting of paper, cardboard, plastic and metal.

6. A cover for an electronic device comprising:

a flexible sleeve, said sleeve having an opening in at least one end thereof for receiving an electronic device, wherein said sleeve is configured to allow the electronic device to be selectively removed from said sleeve.

a means for applying said flexible sleeve onto said electronic device, comprising an open tubular member, wherein a first end of said open tubular member is attached to said opening in said sleeve and a second end of said open tubular member is adapted to receive said electronic device; and, an electronic device positioned inside said sleeve.

7. The cover for an electronic device as recited in claim 6 wherein said open tubular member is comprised of a material selected from the group consisting of paper, cardboard, plastic and metal.

8. The cover for an electronic device as recited in claim 6 wherein said open tubular member is releasably attached to said opening.

9. The cover for an electronic device as recited in claim 6 wherein said open tubular member is permanently attached to said opening.

10. The cover for an electronic device as recited in claim 6 wherein said flexible sleeve is comprised of plastic.

11. The cover for an electronic device as recited in claim 6 wherein said flexible sleeve is transparent.

12. The cover for an electronic device as recited in claim 6 wherein said sleeve opening further comprises a pressure sensitive adhesive on an inner periphery of said sleeve opening, for selectively sealing said sleeve opening.

13. The cover for an electronic device as recited in claim 6 wherein said open tubular member is secured to said sleeve opening by an adhesive.

14. The cover for an electronic device as recited in claim 6 wherein said open tubular member further comprises a living hinge on opposite sides of said open tubular member.

15. The cover for an electronic device as recited in claim 6 wherein said open tubular member is scored on opposite sides of said open tubular member.

* * * * *